US009021964B2

(12) United States Patent
Peng

(10) Patent No.: US 9,021,964 B2
(45) Date of Patent: May 5, 2015

(54) FOLDING TABLE

(71) Applicant: Cheng Peng, Rowland Heights, CA (US)

(72) Inventor: Cheng Peng, Rowland Heights, CA (US)

( * ) Notice: Subject to any disclaimer, the term of this patent is extended or adjusted under 35 U.S.C. 154(b) by 0 days.

(21) Appl. No.: 14/176,816

(22) Filed: Feb. 10, 2014

(65) Prior Publication Data

US 2014/0150696 A1 Jun. 5, 2014

(51) Int. Cl.

| | |
|---|---|
| ***A47B 3/00*** | (2006.01) |
| ***A47B 3/12*** | (2006.01) |
| *A47B 9/00* | (2006.01) |

(52) U.S. Cl.

CPC . *A47B 3/002* (2013.01); *A47B 3/12* (2013.01); *A47B 9/00* (2013.01)

(58) Field of Classification Search

CPC .... A47B 3/00; A47B 3/002; A47B 2003/008; A47B 3/04; A47B 31/04; A47B 43/00; A47F 5/13

USPC ..... 108/115, 116, 124, 127, 34, 147.19, 108/147.21, 157.17, 67; 248/188, 188.1, 248/150, 528, 136, 166; 52/645, 646; 135/131, 145, 146, 147, 144, 157; 297/16.2, 163.1, 42

See application file for complete search history.

(56) References Cited

U.S. PATENT DOCUMENTS

| | | | | |
|---|---|---|---|---|
| 2,057,334 | A * | 10/1936 | Hannum | 108/157.17 |
| 4,607,656 | A * | 8/1986 | Carter | 135/145 |
| 5,865,127 | A * | 2/1999 | Carter | 108/115 |
| 5,944,040 | A * | 8/1999 | Jang | 135/126 |
| 6,173,726 | B1 * | 1/2001 | Talmadge | 135/144 |
| 6,283,136 | B1 * | 9/2001 | Chen | 135/144 |
| 6,374,843 | B1 * | 4/2002 | Zou | 135/145 |
| 6,725,873 | B2 * | 4/2004 | Liu | 135/145 |
| 7,178,539 | B2 * | 2/2007 | Patel et al. | 135/131 |
| 7,389,887 | B2 * | 6/2008 | Liang | 211/149 |
| 8,292,361 | B2 * | 10/2012 | Chen | 297/42 |
| 2007/0277709 | A1 * | 12/2007 | Carter | 108/115 |
| 2010/0317498 | A1 * | 12/2010 | Mallookis et al. | 482/148 |
| 2012/0285351 | A1 | 11/2012 | Cohen | |
| 2012/0304901 | A1 * | 12/2012 | Volin | 108/127 |
| 2013/0233210 | A1 | 9/2013 | Jin et al. | |

* cited by examiner

*Primary Examiner* — Janet M Wilkens

(74) *Attorney, Agent, or Firm* — Che-Yang Chen; Law Office of Michael Chen

(57) ABSTRACT

A folding table may include a table top and a supporting frame. The supporting frame may have a leg portion, an interconnecting portion and a central supporting structure; and the table top that is detachable from the supporting frame may have a plurality of connected table pieces. The leg portion includes a plurality of legs and the interconnecting portion is used to connect the legs of the leg portion, and the central supporting structure is located at center portion of the supporting frame to provide additional support to the supporting frame and is configured to start a table folding process.

12 Claims, 10 Drawing Sheets

FOLDING TABLE

FIELD OF INVENTION

The present invention relates to a folding table, and more particularly to a folding table having a detachable table top and a collapsible supporting frame that can be more portable and more convenient for storage.

BACKGROUND OF THE INVENTION

In recent years, more and more people love outdoor and recreational activities such as camping, field trips, or Bar-B-Q during their free time because many people may endure high pressure at work, and have accumulated a lot of tension and stress. Not only can these outdoor activities help people release the stress, but also improve quality of life. Since most places for abovementioned outdoor activities do not have all the facilities, it may be more convenient for people to bring some outdoor furniture such as folding chairs, tables, etc. Thus, making the outdoor furniture light and easy to carry around become important issues for outdoor furniture manufacturers.

A conventional folding table may include a frame which can be collapsed and a table top that is assembled to the frame. The frame and the table top may be fixed together or they can be separated from each other when the folding table is disassembled. As previously mentioned, a desirable folding table has to be light so the user can easily carry the folding table around, and is expected to be conveniently operated, especially during the folding and unfolding processes. Furthermore, the desired folding table may have to be collapsed to a very compact size to reduce the space used for storage and transportation. Also, a desirable visual design is becoming an increasingly important factor for a folding table to be commercially successful in the current market.

US 2012/0285351 to Cohen discloses a lightweight folding table having a tabletop and legs that fold into smaller sizes. The tabletop has a main panel, a first side flap panel, and a second side flap panel. The first side flap panel and the second side flap panel are joined to the main panel with hinge connections. The hinge connections enable the first side flap panel and the second side flap panel to rotate from open positions that are coplanar with the main panel to folded positions that are under the main panel. However, the lightweight folding table disclosed by Cohen does not seem sturdy and the folding table includes too many pieces that have to be put together, which decreases the structural strength of the folding table and the assembly process may take long time. Recently, US 2013/0233210 discloses a foldable table including a table top and legs that are movable between an extended position and a collapsed position with better structural strength. However, increasing the structural strength also increases the weight of the folding table, as well as material and manufacturing costs. In addition, this type of folding tables is not visually desirable for certain situations.

Therefore, there remains a need for anew and improved folding table that is structural strong, light-weight, visually desirable, and can be easily operated to overcome the problems stated above.

SUMMARY OF THE INVENTION

It is an object of the present invention to provide a folding table that can be quickly and easily folded and unfolded with strong structural support.

It is another object of the present invention to provide a folding table that can be folded to a compact unit to be more portable and more convenient for storage.

It is a further object of the present invention to provide a folding table with adjustable height and is visually desirable for various purposes.

In one aspect, a folding table in the present invention may include a supporting frame and a table top, and the supporting frame includes a leg portion, an interconnecting portion and a central supporting structure. In one embodiment, the leg portion may include four legs and the interconnecting portion is used to connect these legs to form a square supporting frame. The central supporting structure is located at center portion of the supporting frame to provide additional support to the folding table and more importantly, the central supporting structure is used to start the folding process of the folding table. The table top has one or more table pieces that are connected together and can be arranged to enclose the folded supporting frame therein, or unfolded as a flat surface putting on top of the supporting frame when in use.

In one embodiment, the leg portion has four legs that are located at four corners of the square supporting frame, and each leg has an upper section and a lower section. The upper section has a receiving space therein to completely and telescopically receive the lower section, so the height of the folding table is adjustable. It is noted that when the lower section is completely pulled out from the upper section, the lower section would be locked by a locking unit on each leg to secure the structure of the supporting frame. Furthermore, bottom portion of each lower section has a padding member which may be made of plastic, rubber or other applicable materials to prevent the folding table from unwanted lateral movements. A first connector is located on top of each leg, and a second connector is located within a predetermined distance below the first connector. Both the first connector and second connector are configured to connect with the interconnecting portion and the central supporting structure to form the supporting frame of the folding table.

In another embodiment, the first connector may include a pair of interconnecting slots to receive the upper bar members of the interconnecting portion, and a connecting slot located between two interconnecting slots to receive the connecting bars of the central supporting structure.

The interconnecting portion has four identical sub-portions to connect four legs to form the square supporting frame. Each of the sub-portions has an upper connecting portion and a lower connecting portion, wherein the upper connecting portion is configured to pivotally connect with two first connectors while the lower connecting portion is configured to pivotally connect with two second connectors. More particularly, the upper connecting portion has two upper bar members and the lower connecting portion has two lower bar members. An interconnector is used to pivotally connect two upper bar members and two lower bar members.

The central supporting structure includes a plurality of connecting bars and a control piece to control the movement of the central supporting structure. In an exemplary embodiment, the control piece has four connecting slots underneath to pivotally connect with one end of each of the connecting bar, and the other end of each connecting bars is connected to the first connector on each leg to form a diagonal supporting structure.

The table top has a plurality of table pieces connected together to form a front surface of the table top. On back side of the table top, a plurality of securing units are disposed on two sides of the back side of the table top, and the securing units are aligned with two parallel upper connecting portions (each having with two parallel upper bar members), so the hollow securing units can be engaged with the upper bar members when a certain degree of pressure is applied to the front surface of the table top. It is noted that each of the four corners of the back side of the table top has a conjugating unit that can be inserted to a receiving slot on the first connector to further secure the table top.

In an exemplary embodiment, the control piece is mechanically connected with the locking unit, so when the control piece is lifted, the locking unit is triggered to unlock the lower section, and the lower section can be received in the receiving space of the upper section. In one embodiment, the lower section can move up automatically into the upper section when the control piece is lifted. It is also noted that the control piece is mechanically connected with the second connector, so the lower section can be locked again by the second connector when the lower section is received in the upper section to prevent the lower section from coming out when the supporting frame is transported.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood that the same or equivalent functions and components may be accomplished by different embodiments that are also intended to be encompassed within the spirit and scope of the invention.

Unless defined otherwise, all technical and scientific terms used herein have the same meanings as commonly understood to one of ordinary skill in the art to which this invention belongs. Although any methods, devices and materials similar to or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present invention. Nothing herein is to be construed as an admission that the inventors are not entitled to antedate such disclosure by virtue of prior invention.

Figure 1:
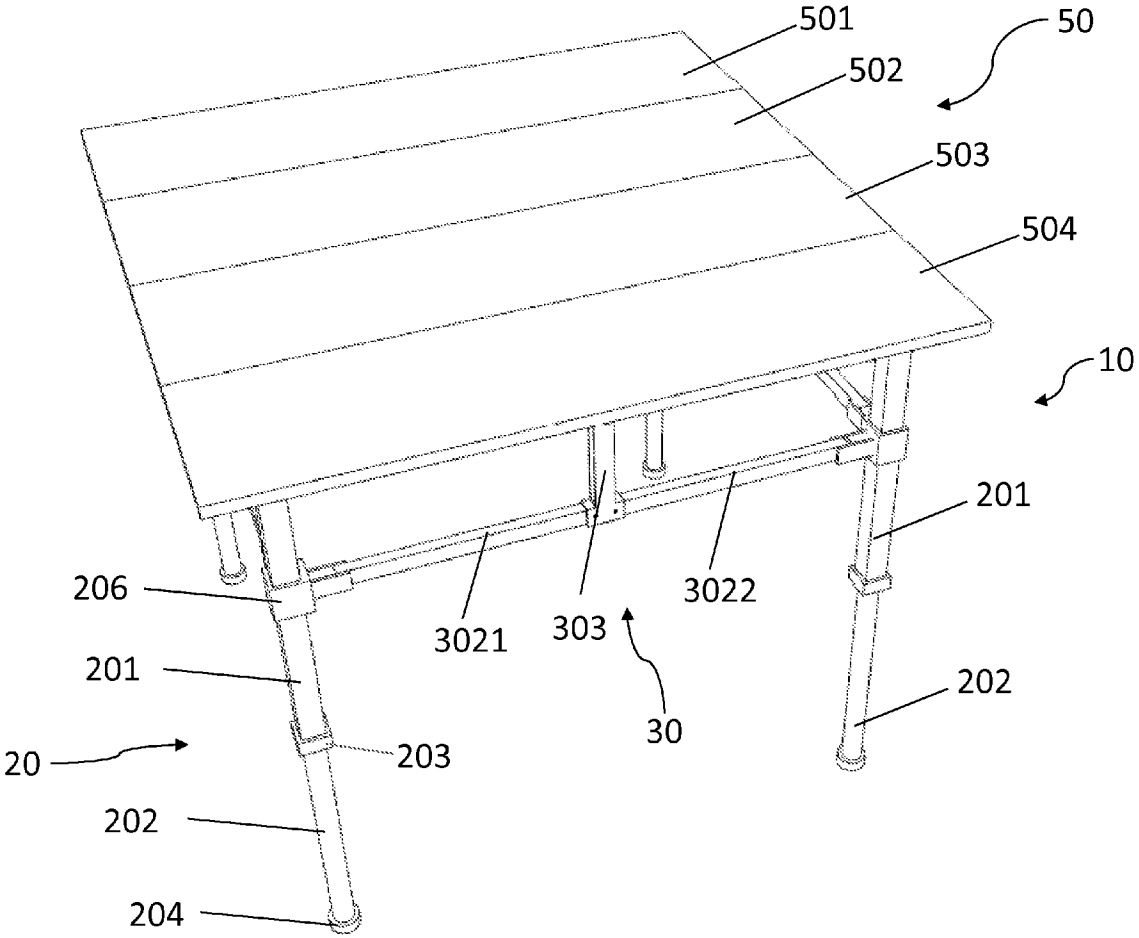
FIG. 1 illustrates a schematic view of a folding table having a supporting frame and a table top in the present invention.
Figure 2:
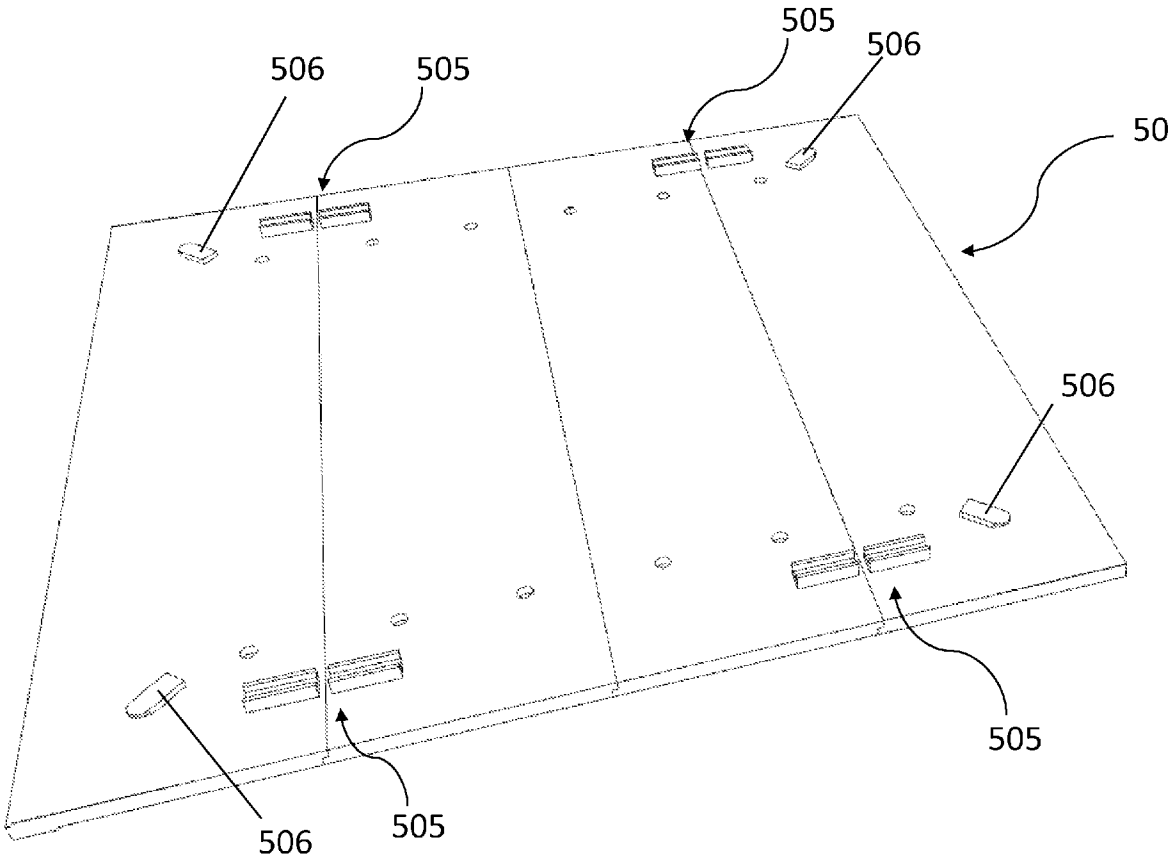
FIG. 2 is a schematic view of the back side of the table top of the folding table in the present invention.
Figure 3:
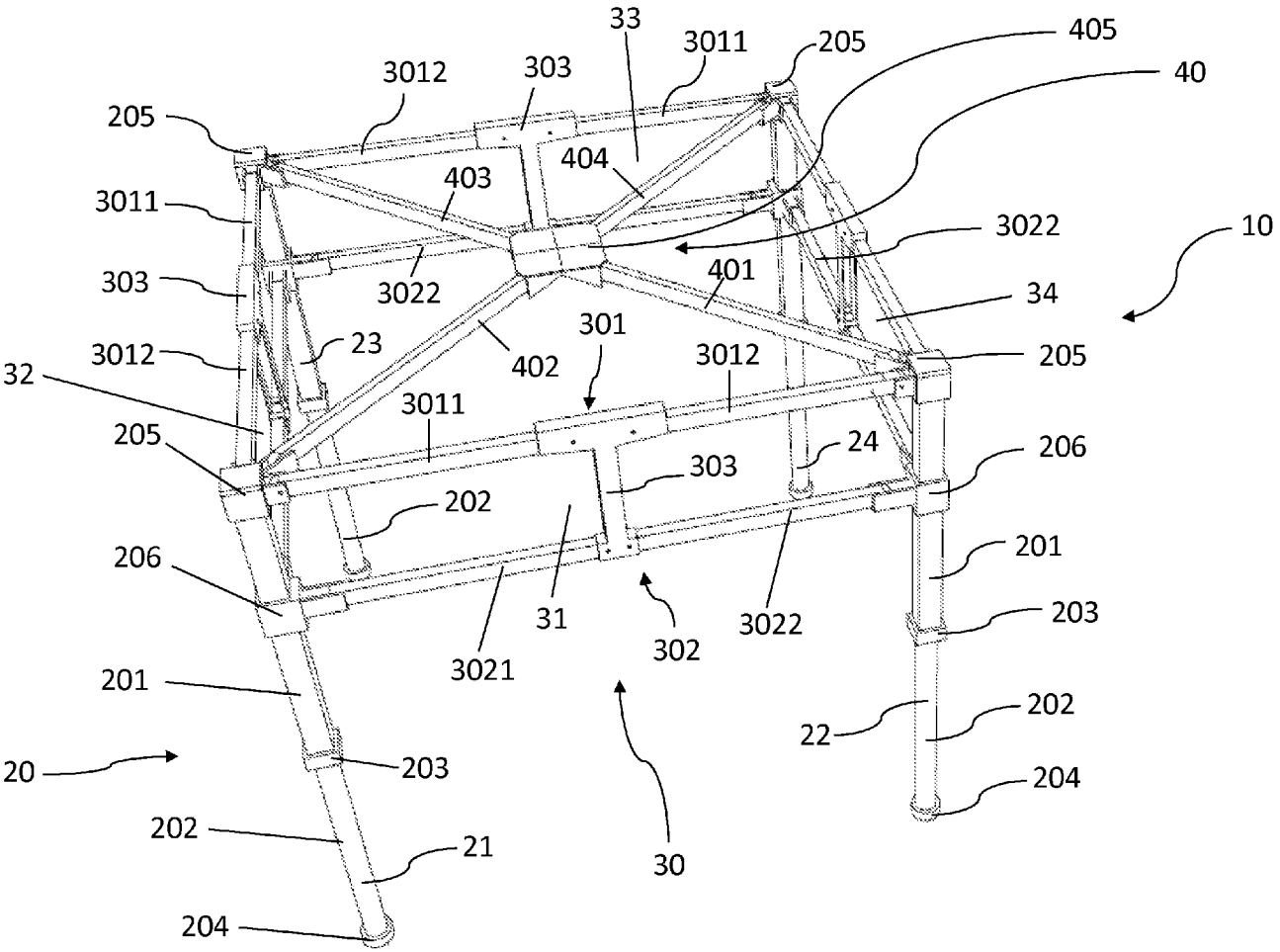
FIG. 3 illustrates a schematic view of the supporting frame of the folding table in the present invention.
Figure 9:
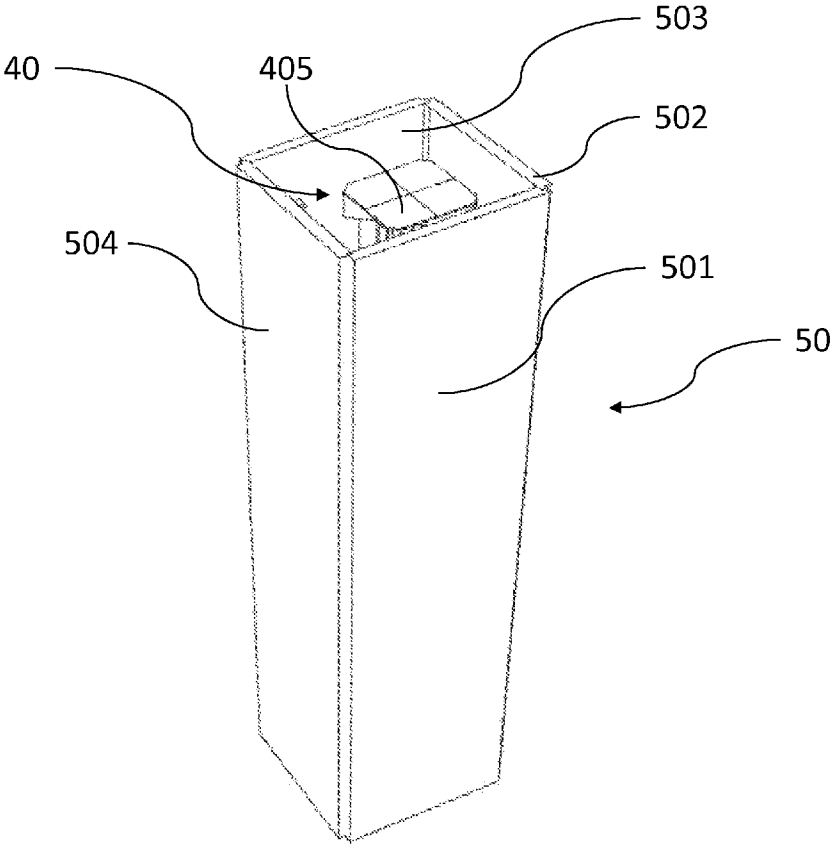
FIG. 9 illustrates a schematic view of the supporting frame enclosed by the table top in the present invention.

In order to further understand the goal, characteristics and effect of the present invention, an exemplary embodiment of the present invention, and the operation and benefit of the exemplary embodiment are illustrated along with the drawings as following:

As illustrated in FIGS. 1 to 3, a folding table in the present invention may include a supporting frame 10 and a table top 50, and the supporting frame 10 includes a leg portion 20, an interconnecting portion 30 and a central supporting structure 40. In one embodiment, the leg portion 20 may include four legs (21, 22, 23, 24), and the interconnecting portion 30 is used to connect these legs to form a square supporting frame 10 as shown in FIG. 3. The central supporting structure 40 is located at center portion of the supporting frame 10 to provide additional support to the folding table and more importantly, the central supporting structure 40 is used to start the folding process of the folding table. The table top 50 has one or more table pieces (501, 502, 503, 504) that are connected together and can be arranged to enclose the folded supporting frame 10 therein as shown in FIG. 9, or unfolded as a flat surface putting on top of the supporting frame 10 when in use.

Figure 4:
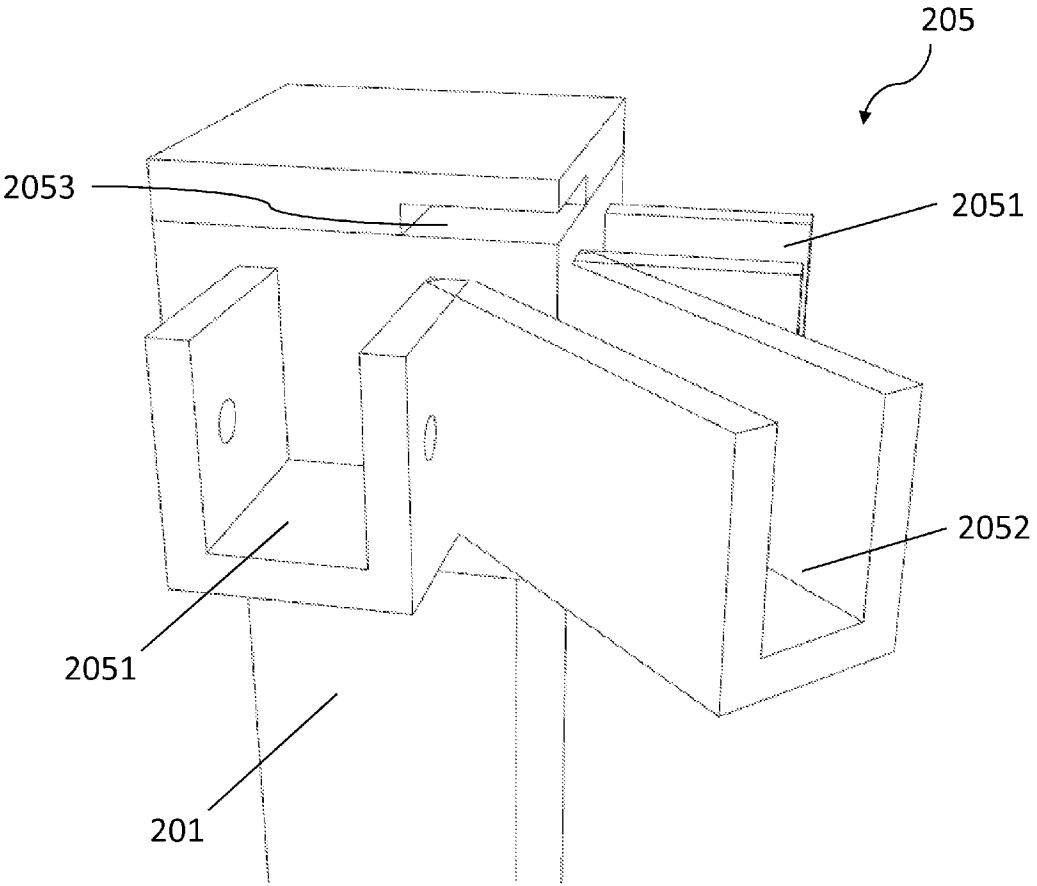
FIG. 4 illustrates a schematic view of the first connector of the folding table in the present invention.
Figure 10:
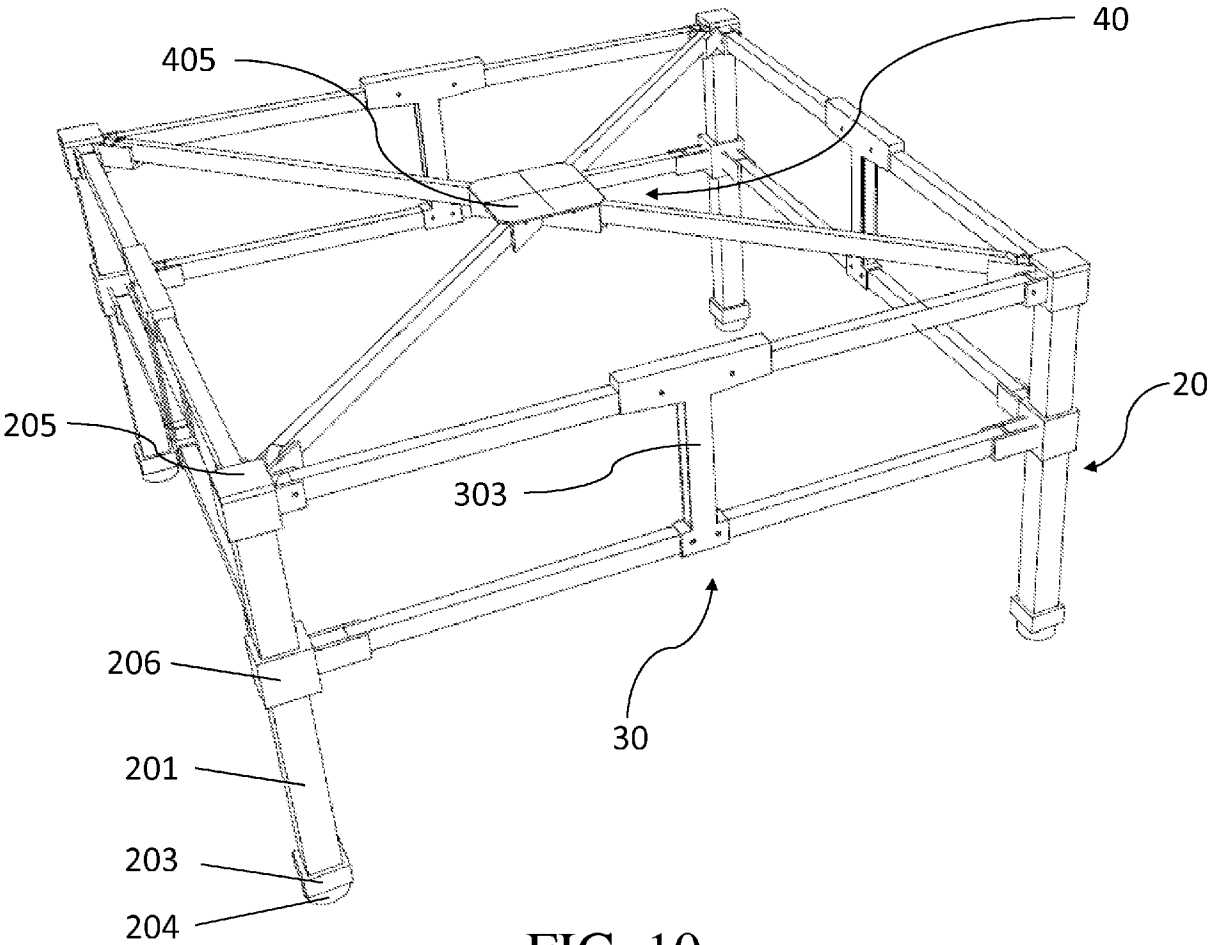
FIG. 10 illustrates a schematic view of the supporting frame when the lower section is still received in the upper section.

More specifically, the leg portion 20 has four legs (21, 22, 23, 24) that are located at four corners of the square supporting frame 10, and each leg has an upper section 201 and a lower section 202. The upper section 201 has a receiving space therein to completely and telescopically receive the lower section 202, so the height of the folding table is adjustable as shown in FIGS. 3 and 10. It is noted that when the lower section 202 is completely pulled out from the upper section 201, the lower section 202 would be locked by a locking unit 203 on each leg to increase structural stability of the supporting frame 10. Furthermore, bottom portion of each lower section 202 has a padding member 204 which may be made of plastic, rubber or other applicable materials to prevent the folding table from unwanted lateral movements. A first connector 205 is located on top of each leg (21, 22, 23, 24), and a second connector 206 is located within a predetermined distance below the first connector 205. Both the first connector 205 and second connector 206 are configured to connect with the interconnecting portion 30 and the central supporting structure 40 to form the supporting frame 10 of the folding table. As shown in FIG. 4, the first connector 205 may include a pair of interconnecting slots 2051 to receive the upper bar members of the interconnecting portion 30, and a connecting slot 2052 located between two interconnecting slots to receive the connecting bars of the central supporting structure 40.

Figure 6:
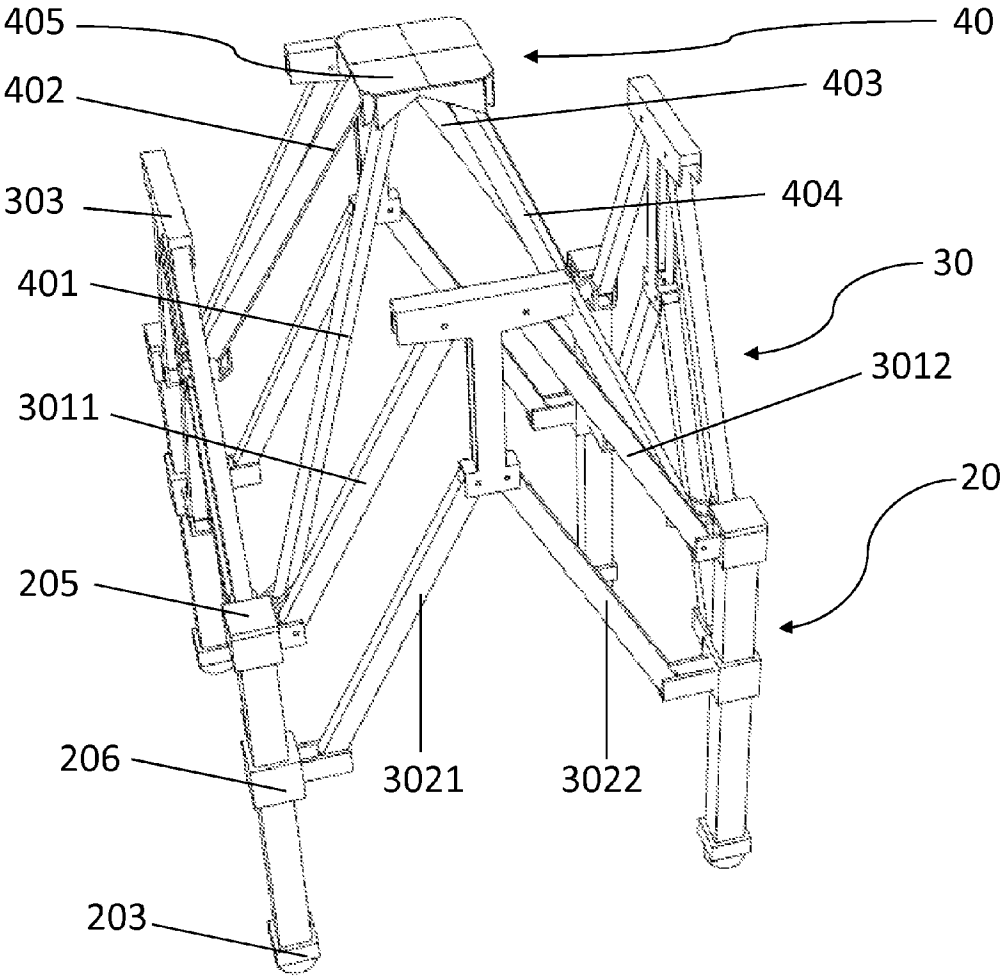
FIG. 6 illustrates a front view of the supporting frame of the folding table in the present invention during the folding process.
Figure 7:
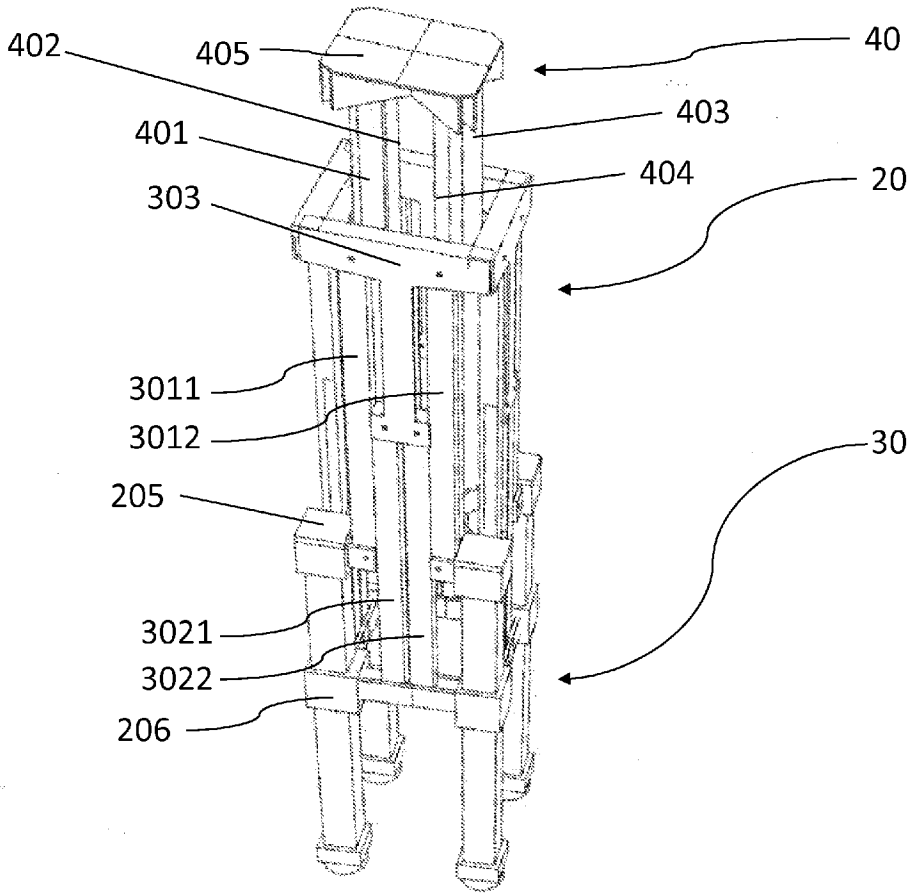
FIG. 7 illustrates a front view of the supporting frame of the folding table in the present invention when the supporting frame is totally folded.

As shown in FIG. 3, the interconnecting portion 30 has four identical sub-portions (31, 32, 33, 34) to connect with four legs to form the supporting frame 10. Each of the sub-portions (31, 32, 33, 34) has an upper connecting portion 301 and a lower connecting portion 302, wherein the upper connecting portion 301 is configured to pivotally connect with two first connectors 205 while the lower connecting portion 302 is configured to pivotally connect with two second connectors 206. More particularly, the upper connecting portion 301 has two upper bar members (3011 and 3012) and the lower connecting portion 302 has two lower bar members (3021 and 3022). An interconnector 303 is used to pivotally connect two upper bar members 3011 and 3012, and two lower bar members 3021 and 3022. As can be seen in FIGS. 3, 6 and 7, the interconnector 303 can be a T-shaped unit to pivotally connect two upper bar members 3011 and 3012 on top portion of the T-shaped unit, and to pivotally connect two lower bar members 3021 and 3022 at bottom portion thereof.

The central supporting structure 40 includes a plurality of connecting bars (401, 402, 403, 404) and a control piece 405 to control the movement of the central supporting structure 40. In an exemplary embodiment, the control piece 405 has four connecting slots underneath to pivotally connect with one end of each of the connecting bars (401, 402, 403, 404), and the other end of each connecting bars (401, 402, 403, 404) is connected to the first connector 205 on each leg to form a diagonal supporting structure as shown in FIGS. 3 and 10.

The table top 50 has a plurality of table pieces (501, 502, 503, 504) connected together to form a front surface and a back surface of the table top 50. As shown in FIG. 2, on back surface of the table top 50, a plurality of securing units 505 are disposed on two parallel sides of the back surface of the table top 50, and the securing units 505 are aligned with two parallel upper connecting portions 301 (each having with two parallel upper bar members (3011, 3012)), so the hollow securing units 505 can be engaged with the upper bar members (3011, 3012) when a certain degree of pressure is applied to the front surface of the table top 50. It is noted that each of the four corners of the back surface of the table top 50 has a conjugating unit 506 that can be inserted to a receiving slot 2053 on the first connector 205 to further secure the table top 50, as shown in FIGS. 2 and 4.

Figure 5:
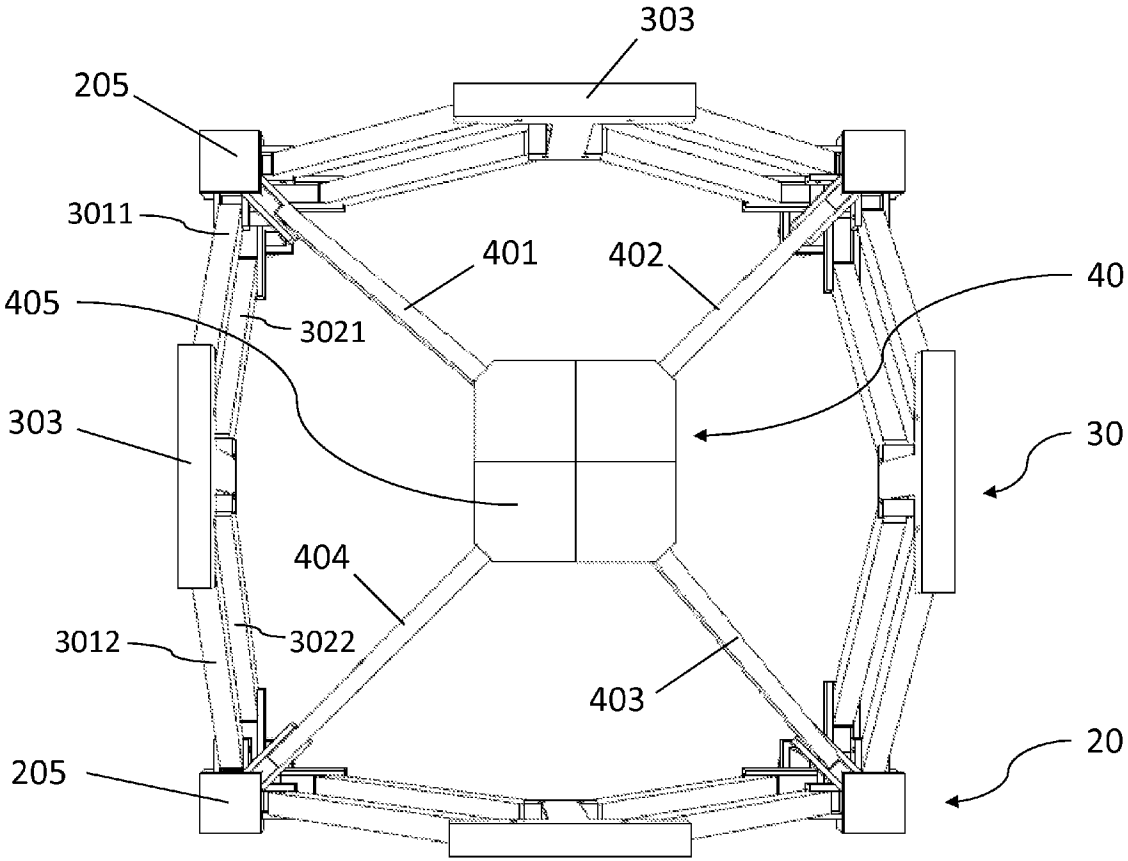
FIG. 5 illustrates a top view of the supporting frame of the folding table when the folding process starts in the present invention.

When the user wishes to fold the folding table in the present invention, he/she can first remove the table top 50 from the supporting frame 10, as shown in FIGS. 1 to 3. To fold the supporting frame 10, the user can simply hold and lift the control piece 405 of the central supporting structure 40, and due to gravity, the entire supporting frame 10 starts to collapse as shown in FIGS. 5 and 6. More specifically, when the control piece 405 is lifted, four connecting bars (401, 402, 403, 404) that are pivotally connected with the control piece 405 are inwardly moved until each connecting bar becomes parallel with the leg portion 20. Meanwhile, the movement of the connecting bars (401, 402, 403, 404) triggers the movement of the interconnecting portion 30 and the leg portion 20. As stated above, on each side of the supporting frame 10, the interconnecting portion 30 has a T-shaped interconnector 303 used to pivotally connect two upper bar members (3011 and 3012) on the top portion thereof, and to pivotally connect two lower bar members (3021 and 3022) at the bottom portion thereof. When the supporting frame 10 starts to collapse, two upper bar members (3011 and 3012) and two lower bar members (3021 and 3022) start to move downwardly until all upper and lower bar members become parallel with the leg portion 20, as shown in FIGS. 6 and 7.

Figure 8:
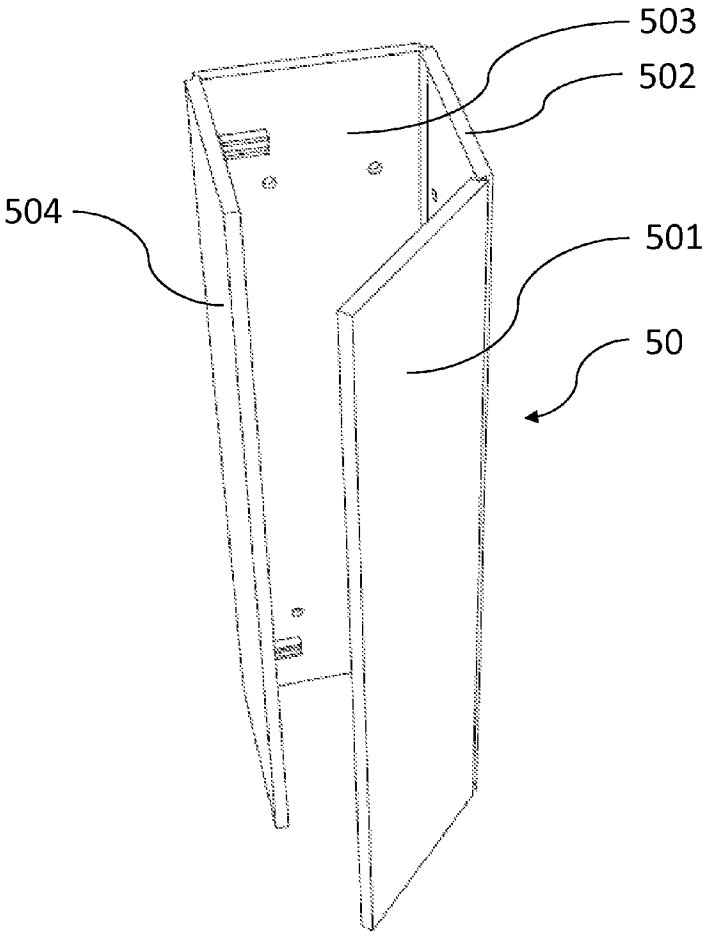
FIG. 8 illustrates a schematic view of the table top when it is folded in the present invention.

It is noted that the control piece 405 is mechanically connected with the locking unit 20, so when the control piece 405 is lifted, the locking unit 203 is triggered to unlock the lower section 202, and the lower section 202 can be received in the receiving space of the upper section 201. In one embodiment, the lower section 202 can move up automatically into the upper section when the control piece 405 is lifted. It is also noted that the control piece 405 is mechanically connected with the second connector 206, so the lower section 202 can be locked again by the second connector 206 when the lower section 202 is received in the upper section 201 to prevent the lower section 202 from coming out when the supporting frame 10 is transported. Therefore, when the user wishes to fold the supporting frame 10, the size of the supporting frame 10 can be significantly reduced and the entire structure thereof can be collapsed to become a compact unit as shown in FIG. 7. The table top 50 can be folded and the supporting frame 10 can be enclosed therein when the supporting frame 10 is fully collapsed and folded, as illustrated in FIGS. 8 and 9. It is advantageous for the user because the folding table can be transported as one unit and the size of the folding table has been significantly reduced.

When the user wishes to use the folding table in the present invention, the unfolding process is as simple as the folding process. The user can simply take the supporting frame 10 out from the folded table top 50 to start the unfolding process. As shown in FIG. 7, the connecting bars (401, 402, 403, 404) of the central supporting structure 40, and the upper bar members (3011, 3012) and the lower bar members (3021, 3022) of the interconnecting portion 30 are parallel with the leg portion 20 when the supporting frame 10 is fully folded. Since the connecting bars (401, 402, 403, 404), and the upper bar members (3011, 3012) and the lower bar members (3021, 3022) are pivotally connected with the control piece 405 and the interconnector 303 respectively, the user may not have to use too much effort to move the connecting bars, the upper bar members and the lower bar members until they become perpendicular with the leg portion 20 to fully unfold the supporting frame 10, as shown in FIG. 10. It is noted that the supporting frame 10 shown in FIG. 10 is ready for use if the user would like to put the table top 50 thereon because sometimes the user may just want to sit on the floor at home with a shorter table, or sit on the lawn or grass when the user is in the park.

As illustrated in FIG. 10, the lower section 202 of each leg is still received inside the upper section 201. Since the control piece 405 is mechanically connected with the second connector 206 and if the user wishes to adjust the height of the folding table, he/she can push the control piece 405 down to trigger the second connector 206 to unlock the lower section 202 inside the upper section 201, and the lower section 202 of each leg can be pulled out to increase the height of the folding table. When the lower section 202 on each leg comes out as shown in FIG. 2, the lower section 202 would be locked again by the locking unit 203 to further secure the structure of the supporting frame 10.

Having described the invention by the description and illustration above, it should be understood that there are exemplary of the invention and are not to be considered as limiting. Accordingly, the invention is not to be considered as limited by the foregoing description, but includes any equivalents.

What is claimed is:

1. A folding table comprising:

a supporting frame including a leg portion, an interconnecting portion and a central supporting structure; and a table top that is detachable from the supporting frame, wherein the leg portion includes a plurality of legs and the interconnecting portion is used to connect the legs of the leg portion, and the central supporting structure is located at center portion of the supporting frame to provide additional support to the supporting frame and is configured to start a table folding process, wherein the leg portion has four legs that are located at four corners of the supporting frame, and each leg has an upper section and a lower section, wherein a first connector is located on top of each leg, and a second connector is located within a predetermined distance below the first connector, and the first connector and second connector are configured to connect with the interconnecting portion and the central supporting structure to form the supporting structure.

2. The folding table of claim 1, wherein the upper section is hollow and configured to telescopically receive the lower section therein, and when the lower section is completely pulled out from the upper section, the lower section is locked by a locking unit on each leg to increase structural stability of the supporting frame.

3. The folding table of claim 2, wherein the central supporting structure includes a control piece that is mechanically connected with the locking unit, so when the control piece is lifted, the locking unit is triggered to unlock the lower section, so the lower section is able to be received in the upper section.

4. The folding table of claim 3, wherein the lower section is configured to automatically move up into the upper section when the control piece is lifted.

5. The folding table of claim 1, wherein the interconnecting portion has four identical sub-portions to connect with four legs, and each of the sub-portions has an upper connecting portion and a lower connecting portion, wherein the upper connecting portion is configured to pivotally connect with two first connectors while the lower connecting portion is configured to pivotally connect with two second connectors.

6. The folding table of claim 5, wherein the upper connecting portion has two upper bar members and the lower connecting portion has two lower bar members, and an interconnector is used to pivotally connect two upper bar members and two lower bar members.

7. The folding table of claim 1, wherein the central supporting structure includes a control piece that is mechanically connected with the second connector, so the lower section is configured to be locked by the second connector when the lower section is received in the upper section to prevent the lower section from coming out when the supporting frame is transported.

8. A folding table comprising:

a supporting frame including a leg portion, an interconnecting portion and a central supporting structure; and a table top that is detachable from the supporting frame, wherein the leg portion includes a plurality of legs and the interconnecting portion is used to connect the legs of the leg portion, and the central supporting structure is located at center portion of the supporting frame to provide additional support to the supporting frame and is configured to start a table folding process, wherein the central supporting structure includes a plurality of connecting bars and a control piece to control movement of the central supporting structure, wherein the control piece has four connecting slots underneath to pivotally connect with one end of each of the connecting bars, and the other end of each connecting bars is connected to the first connector on each leg to form a diagonal supporting structure.

9. The folding table of claim 8, wherein when the control piece is lifted, four connecting bars that are pivotally connected with the control piece are inwardly moved until each connecting bar becomes parallel with the leg portion, and the interconnecting portion and the leg portion are moved corresponding to movement of the connecting bars.

10. The folding table of claim 9, wherein when the connecting bars start to move inwardly, said upper bar members and lower bar members start to move downwardly until all upper and lower bar members become parallel with the leg portion.

11. A folding table comprising:

two parallel upper connecting portions, each of which having two upper bar members;

a supporting frame including a leg portion, an interconnecting portion and a central supporting structure; and a table top that is detachable from the supporting frame, wherein the leg portion includes a plurality of legs and the interconnecting portion is used to connect the legs of the leg portion, and the central supporting structure is located at center portion of the supporting frame to provide additional support to the supporting frame and is configured to start a table folding process, wherein the table top has a plurality of table pieces connected together, and a plurality of securing units are disposed on two parallel sides of back surface of the table top, wherein the securing units are aligned with said two parallel upper connecting portions, and the securing units are configured to engage with the upper bar members of said two parallel upper connecting portions when a certain degree of pressure is applied to front surface of the table top.

12. The folding table of claim 11, wherein the table pieces of the table top are arranged to enclose a folded supporting frame.

* * * * *